United States Patent [19]

Michaud et al.

[11] Patent Number: 4,742,934

[45] Date of Patent: May 10, 1988

[54] CONTAINER STRUCTURE

[75] Inventors: John T. Michaud, Moraga; Harvey Hum, San Francisco, both of Calif.

[73] Assignee: Packaging Corporation of America, Evanston, Ill.

[21] Appl. No.: 880,843

[22] Filed: Jul. 1, 1986

[51] Int. Cl.[4] ..... B65D 41/00

[52] U.S. Cl. ..... 220/306; 229/125.19

[58] Field of Search ..... 220/306, 355, 72; 229/43

[56] References Cited

U.S. PATENT DOCUMENTS

| | | | |
|---|---|---|---|
| D. 215,413 | 9/1969 | Donovan | D9/219 |
| D. 223,144 | 3/1972 | Bloch | D9/185 |
| D. 246,289 | 11/1977 | Boucher | D9/240 |
| D. 263,798 | 4/1982 | Edwards | D9/426 |
| D. 276,216 | 11/1984 | Michaud | D9/425 |
| D. 282,245 | 1/1986 | Young | D9/425 |
| 1,926,240 | 9/1933 | Maas . | |
| 2,490,076 | 12/1949 | Maxon | 219/35 |
| 3,066,824 | 12/1962 | Bostrom | 220/60 |
| 3,101,864 | 8/1963 | Glickman | 220/60 |
| 3,246,786 | 4/1966 | Holley | 215/100.5 |
| 3,447,714 | 6/1969 | Elliot | 220/97 |
| 3,452,896 | 7/1969 | Elliot | 220/306 |
| 3,737,068 | 6/1973 | Bird | 220/306 |
| 4,298,133 | 11/1981 | Davis | 220/306 |
| 4,375,862 | 3/1983 | Kurinsky et al. | 220/306 X |
| 4,390,113 | 6/1983 | Bird | 220/306 |
| 4,412,630 | 11/1983 | Daenen | 220/353 |
| 4,472,440 | 9/1984 | Bank | 220/306 X |
| 4,555,043 | 11/1985 | Bernhardt | 220/306 |
| 4,560,082 | 12/1985 | Sutch | 220/306 X |

OTHER PUBLICATIONS

Anon., "Show & Sell" (10/85), Kaiser Aluminum & Chemical Corporation.

Anon., "CPET Food Trays See More Action", *Packaging* (Dec. 1985) pp. 59–60.

Anon., "Dual Oven Trays—Signode Commits to Consumer Packaging", *Packaging Digest* (Sep. 1985) pp. 90 et seq.

*Primary Examiner*—Steven M. Pollard

*Attorney, Agent, or Firm*—Neuman, Williams, Anderson & Olson

[57] ABSTRACT

A substantially spill proof container for foodstuffs and the like and particularly for comestibles of the liquid or semi-liquid variety wherein the container lid is provided with an improved anti-spillage interior wall which operates in conjunction with an improved snap locking of the lid to the container tray only at spaced points along the lid's periphery to inhibit spillage of the container's contents during lid closure and opening and without interfering with any such opening.

5 Claims, 3 Drawing Sheets

CONTAINER STRUCTURE

BACKGROUND OF THE INVENTION

The present invention relates to container structures and more particularly to a spill proof container used for comestibles or the like, wherein the comestibles or foodstuffs in the container may be in a liquid or semi-liquid condition. The container of the instant invention in its various embodiments is especially useful in the merchandizing of fast and convenience type food products including in particular food products designated as carryout type foods. In the fast and convenience food industry product costs, speed of assembly, ruggedness and resistance to abuse, ease of handling, reclosure and reuse are all highly desirable characteristics of acceptable containers.

In more recent times the public is also requiring that at least the bottom or tray portion of the container be "dual oven heatable" i.e. the purchaser-user wants to be able to heat the container tray and its contents in either a conventional or a microwave oven regardless of the size, shape or internal configuration of the tray. In other words the tray material preferably should be a microwave penetrable polymeric plastic material.

Prior art containers of the type under consideration are represented by various patents as follows: U.S. Pat. Nos. 1,926,240; 2,490,076; 3,066,824; 3,101,864; 3,246,786; 3,447,714; and 4,412,630, as well as design U.S. Pat. Nos. D. 215,413; D. 223,144; D. 246,289; D. 263,798; D. 276,216; and D. 282,245.

The pertinent prior art containers as disclosed in the aforesaid patent art are not completely acceptable to today's purchasing public for various reasons. For example, the container closure of U.S. Pat. No. 3,066,824 relies on the use of a separate implement such as a knife blade to obtain a complete and full release of the container lid from the tray, while the snap-on container cover of U.S. Pat. No. 3,101,864 is snap locked to its associated tray for the full periphery of each. This makes the initial and the subsequent full release of lid and tray in such a container structure without spillage very problematical. In fact such a locking scheme allows little or no room or tolerance for container distortion during handling, filling or opening without breaking the seal between container parts and increasing the possibility of spillage.

This lack of distortion acceptance without spillage, etc., also appears to be a drawback in the case of the container of U.S. Pat. No. 3,447,714 wherein in the case of a multi-sided or polygonal-type container body, the snap-on locking of the body cover or lid occurs, if at all, along the full length of the several sides rather than at selected points, e.g. the corners. The lid corners also are equipped with special stacking shoulders that could interfere with the normal lid release and opening. Such features, plus the lack of a spillage barrier or splash-guard type wall on the cover, not only make such a container difficult to open but also enhance the chance of spillage and lack of fluid food control upon lid and tray release.

The continuous peripheral snap-on lid feature of U.S. Pat. No. D. 276,216 likewise poses spillage problems for liquid and semi-liquid foodstuffs during opening of the container. Carry out containers, because of the nature of the business in which they are used, must be as spill-proof and splash-proof as possible in order to find full acceptability.

Other examples of prior art plastic containers having snap-on lids but not full spill or leak proof properties and over which the instant container structure is an improvement are to be found in Kaiser Aluminum & Chemical Corporation's Advertising Brochure of 1985 and identified by Brochure Number PB-626 8M 10-85.

SUMMARY OF THE INVENTION

The instant invention is concerned with a substantially spill proof container lid and tray assembly wherein the lid and tray have matching polygonal configurations and unique overlapping, generally fully sealable, continuous hat-shaped peripheral segments. The peripheral segment of the lid loosely yet sealably overlies the hat-shaped segment of the tray in the assembled container except in the corner areas or the areas of intersection of the various sidewalls of the container tray and lid. In these corner areas, the lid is both sealed and snap locked to the tray. This feature of the corner areas being the only sectors of the container assembly that are snap-locked together, in conjunction with use of an improved anti-spillage wall on the container lid's peripheral segment, means that the instant container is particularly saleable as a readily openable and substantially leak and spill-proof container.

DETAILED DESCRIPTION

Figure 1:
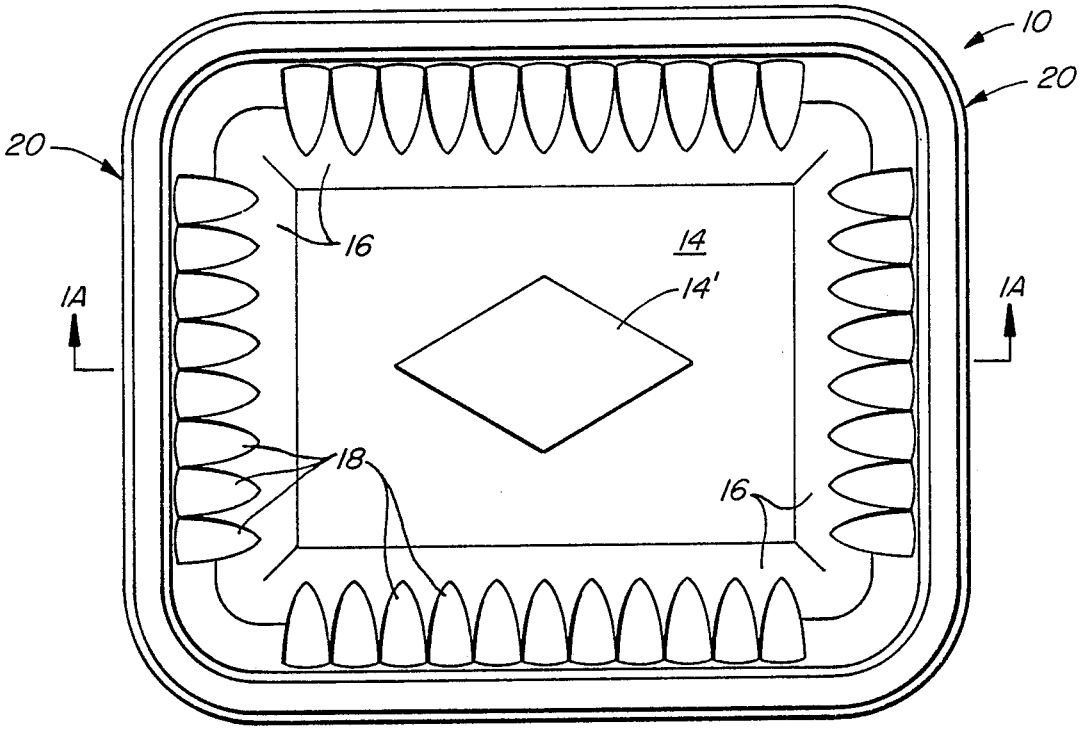
FIG. 1 is a top plan view of a preferred embodiment of the container tray of the instant invention.
Figure 1A:
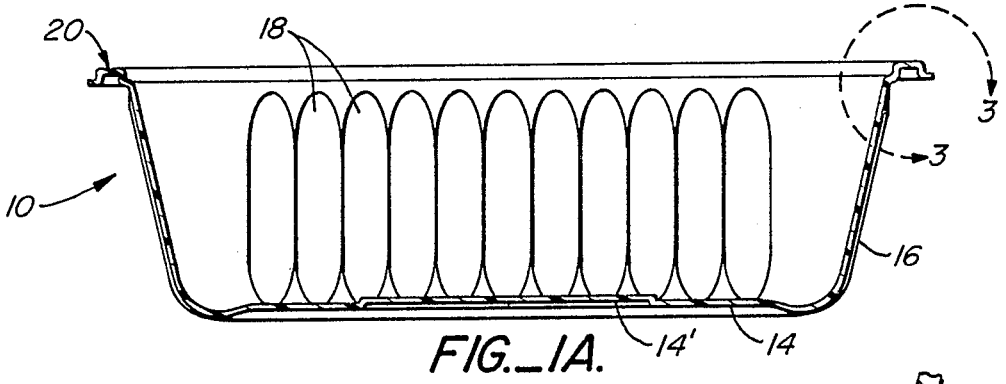
FIG. 1A is a cross-sectional view of the tray of FIG. 1 taken generally along line 1A—1A thereof.

With further reference to the drawings and particularly FIGS. 1 to 5, the improved substantially leak proof container assembly or structure of the instant invention in one preferred embodiment thereof is generally comprised of a container tray 10 of polygonal configuration and fabricated from a suitable plastic material that can be readily formed or molded under heat and pressure and is microwave penetrable. One such plastic material is a plastic which has dual oven heatable characteristics such as crystallized polyethylene terephthalate. This plastic material is more fully discussed and described in an article entitled "CPET Food Trays See More Action" at pages 59 and 60 of "Packaging" for December, 1985. This article notes that the aforesaid material can readily be shaped by a thermoforming operation into various container tray sizes, shapes, and configurations, including those with food dividers, etc. This same general type of plastic material is also reviewed, and its use as a basic container tray material discussed at some length, in an article in "Packing Digest" for September, 1985, entitled "Dual Oven Trays—Signode Commits to Consumer Packaging." Reference may be made to these publications for further details regarding dual oven heatable materials.

Container lid 12 is preferably made from a clear, semi-rigid (i.e., somewhat flexible), transparent plastic material such as oriented polystyrene in order for the food contents or comestibles in the assembled container to be readily visible and the exact condition of the same readily apparent to the user-purchaser. Since lid 12 is normally removed from tray 10 before the tray and its contents are inserted and heated in a conventional or microwave oven, the plastic material for the lid need not be as thick or rugged as the material for the tray. In any event it is preferably fabricated from a thinner guage sheet of plastic than that of tray 10 for resiliency and flexibility during its release from and attachment to the tray. On the other hand it should still have sufficient stiffness to effectively resist distortion and deformation under normal conditions of use and storage, as well as assembly with a filled container tray by means of standard mechanical closing equipment.

Tray 10 is of a matching polygonal configuration to that of lid 12 and vice versa. In the embodiment illustrated, tray 10 is provided with a bottom 14 that may be slightly recessed and, if desired, may have a central embossment 14' or the like for receiving a similarly shaped proturbence or upstanding central embossment 32' on lid top 32 of an underlying lid-tray combination. This is for the purpose of interlocking nested tray bottoms and container lids when assembled containers filled with foodstuffs are stacked one on another, thus preventing one filled container from sliding relative to another similarly filled container located above or below the first mentioned container. It will be understood that, alternately, the same effect could be achieved by increasing the depth of recessing of bottom 14 and expanding embossment 32' to fill the recessed bottom 14. In this construction, embossment 14' would be omitted.

Tray 10 further includes a series of interconnected sidewalls 16 and although only four such walls are illustrated in the drawings, the tray can have any number of walls depending on the container-tray configuration desired for any given product. Thus the tray may be triangular, hexagonal, octagonal etc., in plan, with the lid having a matching configuration in plan. If desired, and depending to some extent on individual taste, sidewalls 16 can be provided with reinforcing ribs 18.

Figure 3:
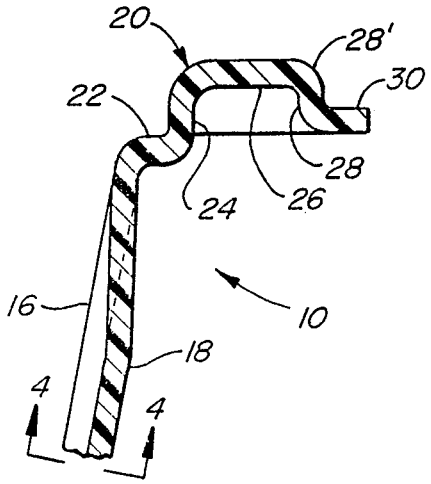
FIG. 3 is an enlarged cross-sectional view of the hat-shaped peripheral segment of the container tray within the circumscribing circle 3 of FIG. 1A.
Figure 4:
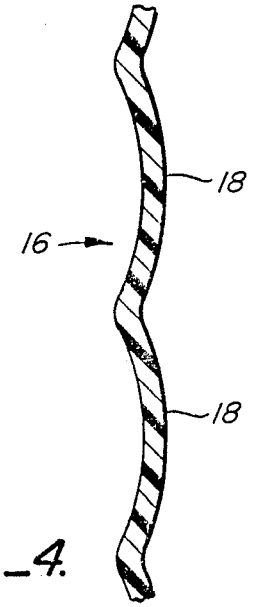
FIG. 4 is a fragmentary sectional view taken along line 4—4 of FIG. 3.
Figure 7:
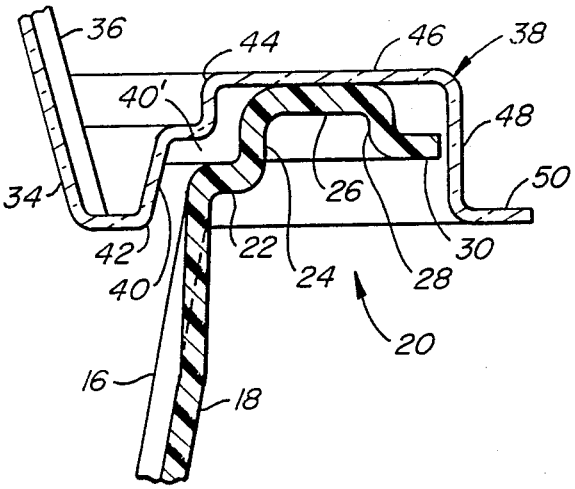
FIG. 7 is an enlarged cross-sectional view of the lid and tray at a point of overlap and sealing engagement therebetween on one of the sides of the lid and tray.
Figure 8:
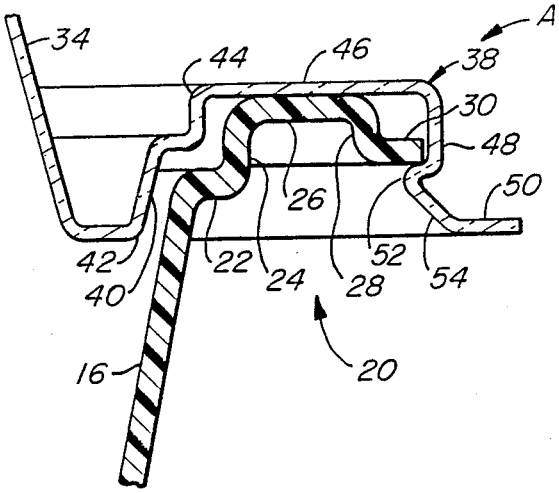
FIG. 8 is an enlarged cross-sectional view of the lid and tray at an overlapped peripheral corner of the lid and tray and discloses the manner in which the lid is snap- locked to the tray at such a corner.

As indicated particularly in FIGS. 3, 7, and 8, the marginal edges or peripheral portions of tray 10 terminate in or form a continuous or uninterrupted, generally hat-shaped, sealing segment 20. Segment 20 includes a continuous inner flange 22 connected to the various sidewalls 16. Flange 22 merges smoothly with the bottom terminus of an upstanding inner wall 24, with wall 24 in turn being connected at its upper end to a top element 26 that may be somewhat rounded off at its edges. An outer downwardly projecting wall 28 is dependingly connected to the outer end of top element 26 of hat-shaped segment 20 by a bend having an arc of a generous radius 28'; while wall 28 merges at its bottom with an outwardly directed or projecting sealing lip 30.

Cooperating container lid 12 of matching configuration with tray 10 is advantageously provided with a top 32 and downwardly and outwardly projecting interconnected sidewalls 34, which also may be ribbed at 36 for reinforcement and/or decorative purposes. Certain of such ribs 36' in an advantageous embodiment of the invention are disposed or set into the corner areas A of the lid so as to slightly overlie these corner areas for purposes to be discussed hereinafter. It will be understood that ribs 36 and 36' are similar in configuration to ribs 18, illustrated in FIG. 4.

Sidewalls 34 of the lid 12, as indicated particularly in FIGS. 5 to 8, also terminate in a peripherally uninterrupted and generally hat-shaped sealing segment 38 which is adapted to match, overlie, and be sealingly locked throughout the continuous length thereof to hat-shaped segment 20 of tray 10, while at the same time being slightly oversized relative to segment 20.

In one advantageous and preferred embodiment of the invention the hat-shaped segment 38 includes an improved continuous and somewhat inclined and stepped anti-spillage or splashguard-like wall or barrier 40 connected directly at its lower terminus 42 to lid sidewalls 34. Wall 40 is of substantial length or depth as compared to the length or depth of either of the walls 24 or 28 of segment 20 of tray 10. The reason for this is to provide, in the closed container, an inner wall or barrier that projects sufficiently down into the inner reaches of tray 10 adjacent the sidewalls thereof and at or close to the level of the container's contents to prevent or inhibit movement by splashing or sloshing, etc., of liquid or semi-liquid foodstuffs into the sealed areas or points of contact between tops 26 and 46 of hat-shaped segments 20 and 38, respectively, of tray 10 and lid 12. This anti-splash, etc., feature is enhanced by the stepped configuration of wall 40 in that it tends to form, in conjunction with the associated parts of tray 10 (e.g., wall 24), a somewhat tortuous path 40' therebetween. Because of the depth of wall 40 and the tortuous path 40', there is minimal likelihood that foodstuffs will penetrate and seep through the seal between lid and tray-top wall elements 46 and 26, even when somewhat rough handling of the assembled container parts prevails and a slight distortion or slippage occurs of the one top element relative to the other top element during handling.

The upper terminus 44 of wall 40 merges with top element 46. Top element 46 can be somewhat flat so as to form an effective seal with the somewhat similarly shaped top element 26 of tray segment 20. The outer edge of top element 46 merges with a downwardly projecting outer wall 48 and wall 48 is connected at its lower extremity to an outwardly projecting stiffening flange 50.

With further reference to the drawings, and in particular FIGS. 7 and 8, it will be observed that wall 48 of lid segment 38 loosely overlies both outer wall 28 and sealing lip 30 of tray segment 20 except in corner areas A or the various points of intersection of the sidewalls of container lid 12 and container tray 10. In a preferred embodiment of the invention these corners are curved with arcs of generous radii.

A preferred embodiment of the invention contemplates that the depending outer wall 48 of the lid's sealing segment 38 will be provided with an inwardly directed reentry portion that forms a unique snap locking ledge 52 at any given corner of lid 12, or area of intersection of the sidewalls of the container lid and tray, for receiving in sliding and locking engagement as well as full sealing relationship the outwardly projecting sealing lip 30 on outer depending wall 28 of tray sealing segment 20. When wall 48 of lid 12 is deformed during manufacture at the corners of lid 12 to provide ledges or shoulders 52, downwardly and outwardly directed inner cam-like surfaces 54 are also advantageously formed on the lower side portion of wall 48 in the corner portions or sectors of lid 12. Thus as lip 30 at each corner of tray segment 20 is snap locked and sealed in a corner area A to its respective underlying ledge element 52, the associated cam surface 54 performs a valuable function in facilitating such interlocking engagement. In addition, the relatively generous arc 28' of the bend in the tray wall 26 allows a little flexure of tray lip 30 to take place as it moves up cam surface 54 to seat itself on anchoring ledge section 52, although most of the flexure takes place in the lid.

Figure 9A:
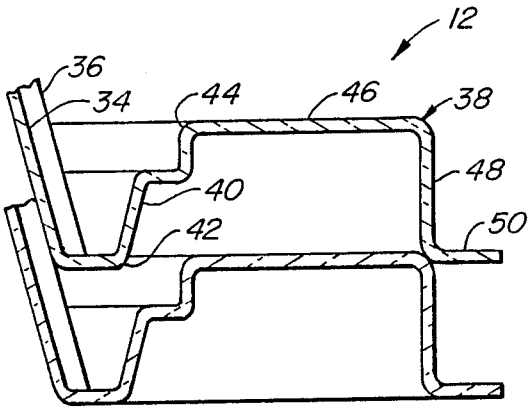
FIGS. 9 and 9A disclose various cross-sectional views of the corners and side portions of a series of stacked and nested lids.
Figure 9:
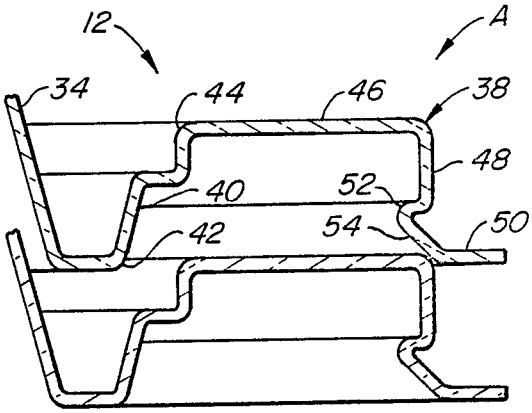

The particular configuration of hat-shaped segment 38, as can be observed by reference to FIGS. 9 and 9A, also greatly enhances the nestability and stackability of lids 12 whereby they can be readily separated and emplaced on filled trays by standard mechanical lidding equipment.

The snap interlocking and seal of lid and tray only at the corners of the assembled lid and tray elements, plus the somewhat loose yet full seal of lid and tray along the planar portions of the filled container, produce a substantially fully peripherally sealed container under typical or normal conditions of handling and usage, including normal or usual distortions and movements of the overlapped tray segment relative to the overlapping lid segment, all as indicated by the dotted lines of FIG. 7.

Finally, since lid 12 is only snap locked to the tray at selected spaced points or at the corners of the tray and lid, as against the entire peripheral portions of the same, minimal resistance is encountered during the initial and continued opening of the container. In other words, once lid 12 is snapped open or its release from the tray initiated at a given corner, a full separation of the remaining portions of lid and tray will readily and quickly take place with minimum effort and spillage, sloshing, and dumping of the contents in an undesirable and uncontrolled fashion.

When wall ribs 36' are used, they assist in the initial opening by stiffening the lid sidewalls in a corner area A, thereby facilitating disengagement of a ledge 52 from the overlying portion of lip 30. During opening of the container, parts of the splashguard wall 40 on lid segment 38 also function in an advantageous manner as follows. Because the peripheral lid segment 38, as it undergoes release from tray segment 20, will tend to be rotated somewhat outwardly, it will contact the tops of the sidewalls of tray 10 due its length or depth, thus in effect producing a desirable if temporary seal between the lid and the food in the tray during at least the initial stages of opening the container.

Figure 2:
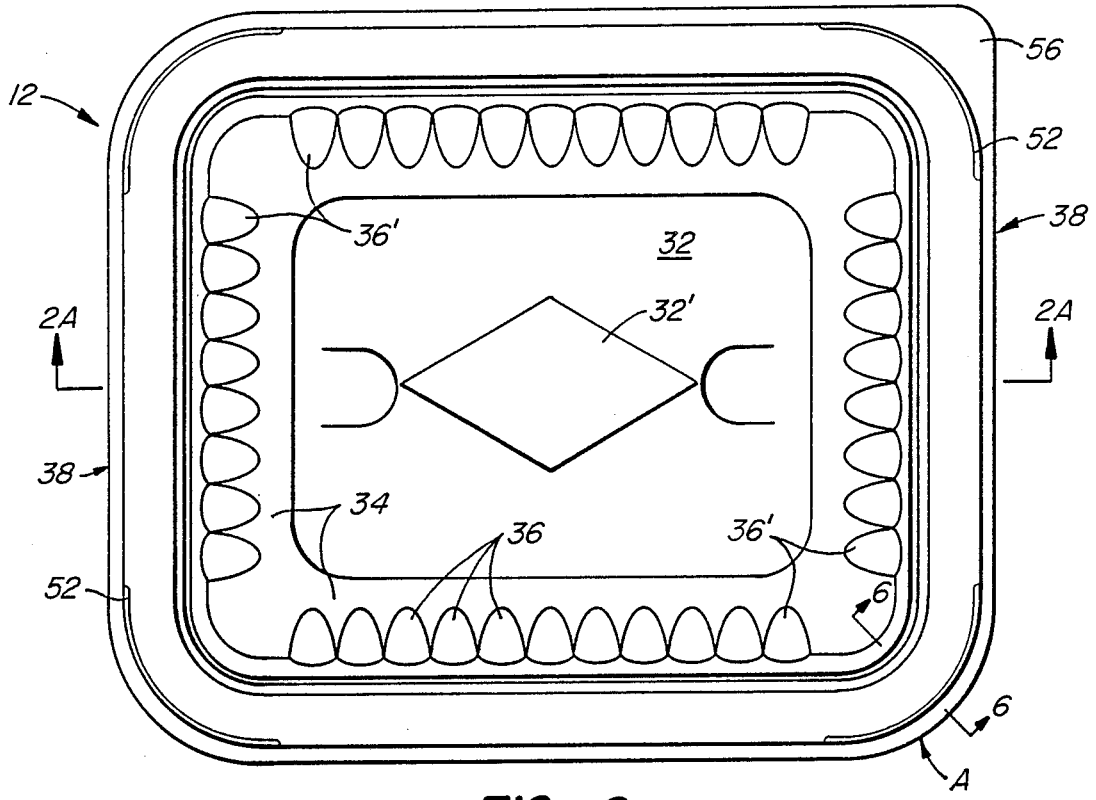
FIG. 2 is a top plan view of the lid for the tray of FIG. 1.
Figure 2A:
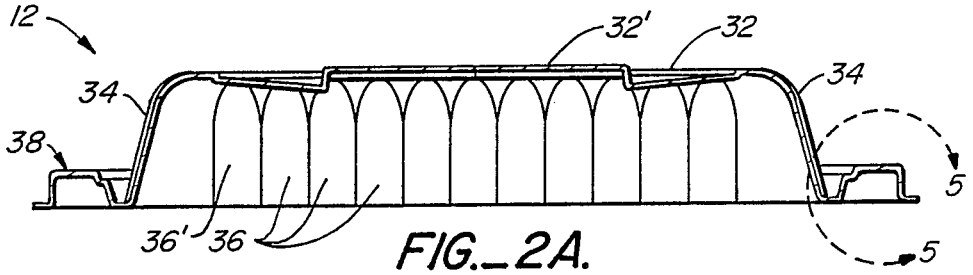
FIG. 2A is a cross-sectional view of the lid of FIG. 2 taken generally along line 2A—2A thereof.
Figure 5:
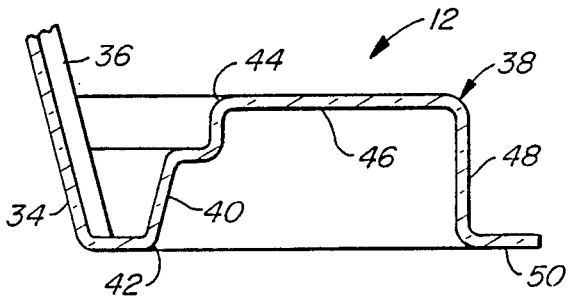
FIG. 5 is a enlarged cross-sectional view of the hat-shaped segmen of the lid within the circumscribing circle 5 of FIG. 2A.
Figure 6:
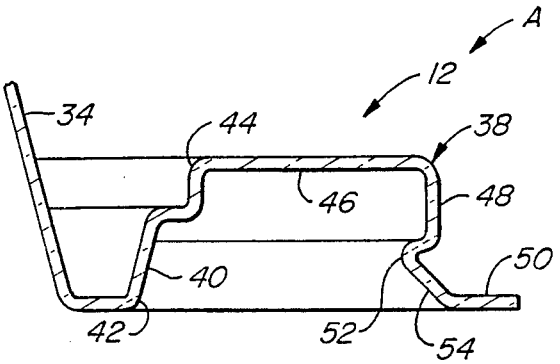
FIG. 6 is an enlarged cross-sectional view of a peripheral corner of the lid of FIG. 2 taken along line 6—6 thereof.

In a further advantageous enbodiment of the invention, a finger tab 56 may be added to the structure of lid segment 38 in one (or more) corner(s) of the lid, as will be observed by reference to FIG. 2, in order to promote the initial or starting separation of lid and tray.

Preferred embodiments of the invention have been disclosed and described. It is obvious that various changes and modifications may be made therein without departing from the spirit and scope of the invention, the scope of which is defined by the appended claims. For example, while the container tray is described, in a preferred embodiment, as being made of a non-metallic, more specifically plastic, material which is microwave penetrable, it will be evident that, where microwave penetrability is not a requirement, the tray can be made of metal, for example aluminum foil, or of a metal foil coated with plastic so the metal tray can be used in a microwave oven.

What is claimed is:

1. A readily openable and relatively spill-proof container for a flowable product comprising a tray of generally polygonal configuration for accommodating the product and having a bottom wall for subtending and supporting the accommodated product, said bottom wall being delimited by upstanding interconnected sidewalls, the latter having upper portions coacting to form a continuous outwardly projecting peripheral seal segment defining an open top for the tray; and a removable reclosable lid of matching polygonal configuration for overlying and closing the tray open top, said lid having a top panel, interconnected side panels delimiting said top panel and depending from the periphery thereof and complemental seal segment projecting outwardly from a lower edge of said interconnected side panels, said lid complemental seal segment being in sealing interlocking engagement with the tray seal segment, when said lid is initially assembled or reassembled on said tray; said tray seal segment having a substantially hat-shaped cross-sectional configuration including an inner flange protruding outwardly from the sidewall upper portions, an inner wall outwardly offset from the sidewall upper portions and extending upwardly from said inner flange, a top wall projecting laterally outwardly from an upper edge of said inner wall, an outer wall depending from an outer edge of said top wall, and a lip projecting outwardly from a lower edge of the outer wall; said lid seal segment having a substantially hat-shaped cross-sectional configuration and including an outwardly stepped continuous inner panel extending upwardly from the lower edge of the interconnected side panels and spaced from the upper portions of the tray sidewalls and the inner flange and inner wall of said tray seal segment and coacting therewith to form an upwardly extending tortuous passage having a lower end communicating with a product-accommodating interior of said tray, a top panel projecting outward from an upper edge of said stepped inner panel and overlying and sealingly engaging the top wall of said tray seal segment and closing off an upper end of the tortuous passage, and an outer panel depending from an outer edge of said top panel and in encompassing relation with the outer wall and lip of said tray seal segment, said outer panel being provided with circumferentially spaced inwardly extending protuberances subtending and interlockingly engaging portions of the lip of said tray seal segment; said protuberances remaining integral with said outer panel while said lid is being assembled or disassembled with respect to said tray.

2. The container structure of claim 1 wherein the container tray is fabricated from a microwave penetrable polymeric plastic material and the said tray is dual oven heatable.

3. The container structure of claim 1 wherein the outer panel of the lid seal segment includes a plurality of circumferentially spaced outwardly and downwardly projecting resilient cam surfaces aligned with and disposed beneath said protuberances whereby when the lid is being assembled on the tray open top, said cam surfaces slidably engage the lip of said tray seal segment effecting outward distortion of said cam surfaces and corresponding protuberances allowing the latter to clear said lip and automatically interlock with the underside of said lip.

4. The container structure of claim 3 wherein said lid is provided with a finger lifting tab projecting outwardly from a predetermined cam surface.

5. The container structure of claim 1 wherein the protuberances of the outer panel of the lid seal segment interlockingly engage the lip of said tray seal segment in the vicinity of corners included in the polygonal configuration of said tray.

* * * * *